United States Patent [19]

Hawkins et al.

[11] Patent Number: 4,480,346

[45] Date of Patent: Nov. 6, 1984

[54] PILLOW SHAM

[75] Inventors: Jeanette C. Hawkins, Stoneville; Nancy W. Sella, Mebane; Carl D. Bradford, Eden, all of N.C.

[73] Assignee: Fieldcrest Mills, Inc., Eden, N.C.

[21] Appl. No.: 428,031

[22] Filed: Sep. 29, 1982

[51] Int. Cl.[3] ..... A47G 9/00

[52] U.S. Cl. ..... 5/490; 5/491

[58] Field of Search ..... 5/491, 492, 490, 434, 5/436; D6/201, 202, 203, 204

[56] References Cited

U.S. PATENT DOCUMENTS

| | | | |
|---|---|---|---|
| 1,269,276 | 6/1918 | Harris | 5/490 |
| 2,446,396 | 8/1948 | Waranch | 5/490 |
| 2,759,200 | 8/1956 | Johnston | 5/490 |
| 3,044,517 | 7/1962 | Levi | 5/490 |
| 3,109,182 | 11/1963 | Doak | 5/434 |
| 3,906,559 | 9/1975 | Bahr | 5/496 |
| 3,974,531 | 8/1976 | Van Pelt | 5/490 |

FOREIGN PATENT DOCUMENTS

| | | | |
|---|---|---|---|
| 929846 | 6/1963 | United Kingdom | 5/490 |

*Primary Examiner*—Alexander Grosz
*Assistant Examiner*—Vinh Luong
*Attorney, Agent, or Firm*—Bell, Seltzer, Park & Gibson

[57] ABSTRACT

A pillow sham formed from sheet material includes lengthwise-extending elastic strips at the sides for lending an overall gathered appearance to the sham.

2 Claims, 10 Drawing Figures

PILLOW SHAM

BACKGROUND OF THE INVENTION

1. Field of the Invention

The present invention relates to pillow covers and, more particularly, to pillow shams.

2. Description of the Prior Art

Pillow shams have long been used to cover and provide a decorative appearance to pillows during the day, the shams being placed over the pillows in the morning and removed at night.

The common pillow sham in widespread use today generally has a rectangular shape and is formed from textile sheet material having opposed front and rear panels, with the rear panel being provided with a transverse opening for insertion and removal of a pillow. Such shams are often provided with borders, such as ruffles, to enhance the decorative appearance.

One disadvantage of the described pillow sham is that it has no elasticity to conform it closely to varying sizes in pillows. Furthermore, the decorative aspect of such a pillow sham is limited to the choice of fabric design and the nature of the border.

SUMMARY OF THE INVENTION

The present invention provides a novel pillow sham that retains the desirable features of conventional pillow shams, while enhancing the sham in both appearance and utility. More particularly, in accordance with the present invention, a pillow sham is provided with a decorative gathered effect, particularly at and adjacent the sides of the sham. Further, the elastic materials used to effect the gathering allow the pillow sham to conform closely to varying sizes of pillows.

In one aspect, the present invention is a pillow sham that comprises an envelope of sheet material having a pillow-receiving opening and a size and shape for accommodating a range of conventional pillow sizes. The sham includes front and rear panels and a pair of opposed sides. Each of the opposed sides include lengthwise extending elastic strips secured thereto. The elastic strips are positioned and secured to the sheet material so as to effect a gathering of the sheet material adjacent thereto and present an overall gathered appearance to the sham.

In particular embodiments the sham is formed from a single rectangular sheet folded upon itself. Further, the gathering of sheet material adjacent the elastic strips is preferably at a ratio on the order of 1.5 inches of fabric to 1 inch of relaxed elastic.

BRIEF DESCRIPTION OF THE DRAWINGS

The invention will be more fully understood from the following detailed description thereof taken in connection with the accompanying drawings, in which.

DETAILED DESCRIPTION

While the present invention will be described hereinafter with particular reference to the accompanying drawings, it is to be understood at the outset of the description which follows that it is contemplated that the present invention may be varied in specific detail while still achieving the desirable characteristics and features of the present invention. Accordingly, the description is to be understood as a board enabling teaching directed to persons skilled in the applicable arts, and is not to be understood as restrictive.

Figure 1:
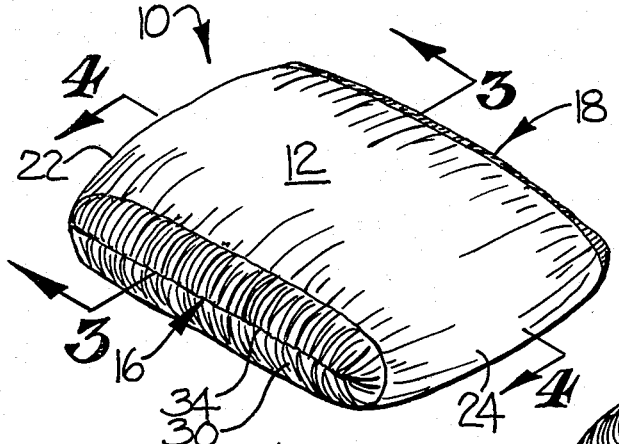
FIG. 1 is a front perspective view of a pillow sham of the invention, with the sham being shown in place over a pillow.
Figure 2:
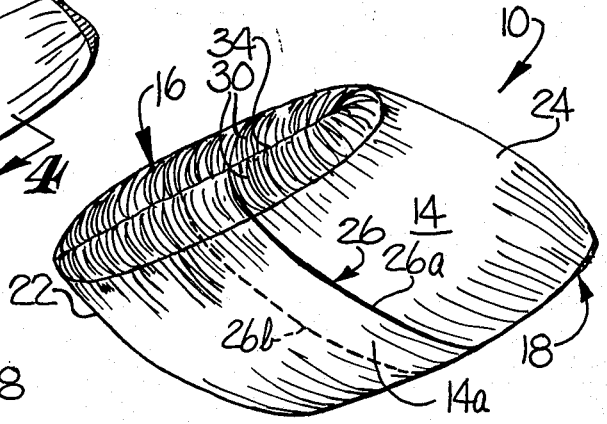
FIG. 2 is a rear perspective view of the pillow sham of FIG. 1, also shown in place over a pillow.
Figure 3:
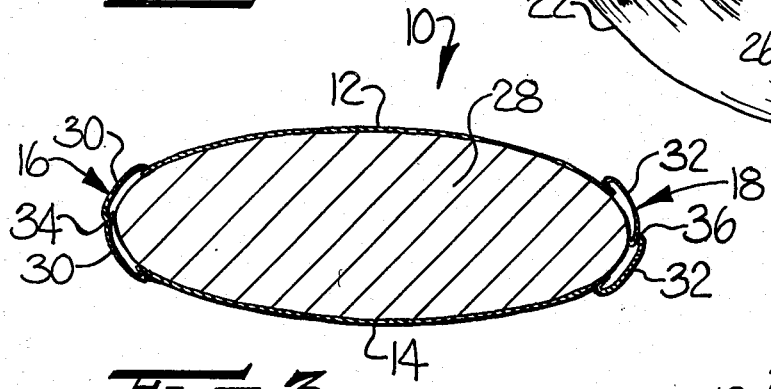
FIG. 3 is a sectional view taken substantially along line 3—3 of FIG. 1.
Figure 4:
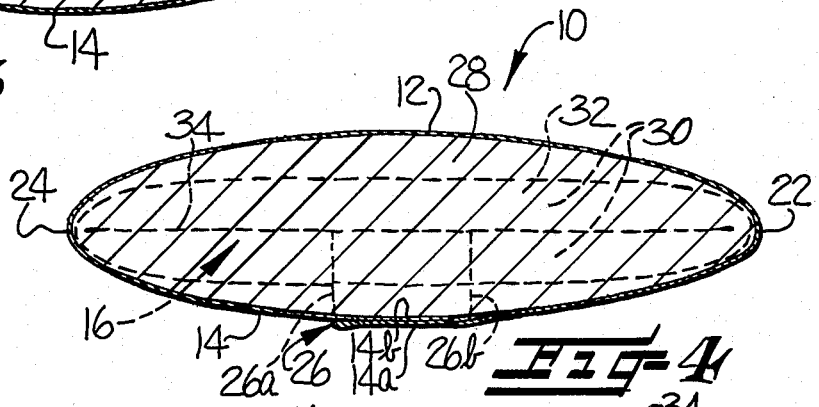
FIG. 4 is a sectional view taken substantially along line 4—4 of FIG. 1.

Referring to the drawings, there is shown an envelope type pillow sham 10 formed from textile sheet material and constructed in accordance with the present invention. Sham 10 includes a front panel or face 12, a rear panel or face 14, opposed sides 16, 18 and opposed ends 22, 24. As best shown in FIG. 2, rear panel 14 includes a transverse opening 26 for insertion of a pillow 28 therein. Sham 10 has an overall gathered appearance provided by elastic strip means described below.

Sham 10 is formed with a length and width such that a single size of sham is suitable for a wide range of conventional pillow sizes. To this end, sham 10 is preferably formed with a length on the order of 26 inches and a width on the order of 21 inches.

Figure 7A:
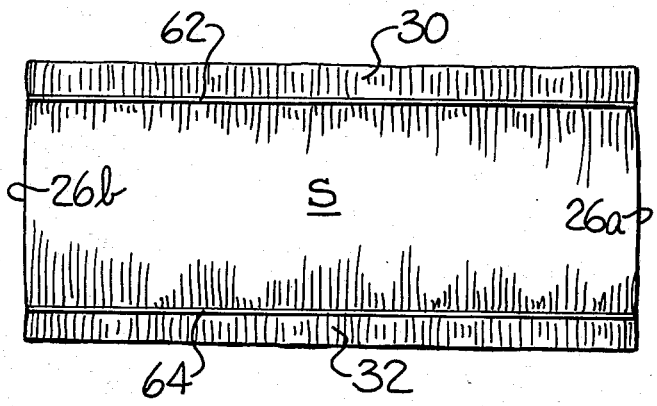
FIG. 7A is a plan view of the rectangular sheet from which the sham of FIGS. 1–6 is formed, and showing the rectangular sheet gathered adjacent its lengthwise edges by a pair of elastic strips.
Figure 7B:
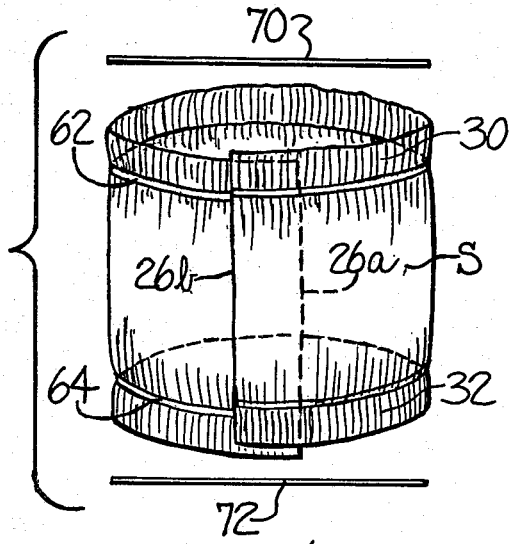
FIG. 7B is an exploded perspective view showing an intermediate stage in the manufacture of the sham.

The structure and features of sham 10 may be best appreciated by first describing a preferred method of manufacture, with initial reference to the intermediate stages of manufacture illustrated in FIGS. 7A and 7B. The body of sham 10 is formed from a single rectangular sheet S. As shown in FIG. 7A, sheet S is initially provided with a pair of elongate elastic strips 62 and 64, with one of said strips being secured adjacent and parallel to each of the lengthwise edges of sheet S to define elongate marginal portions 30, 32. Elastic strips 62, 64 are sewn to sheet S in a stretched condition so that, when the strips relax, the sheet material adjacent the strips is gathered in the manner shown in FIG. 7A.

Figure 5:
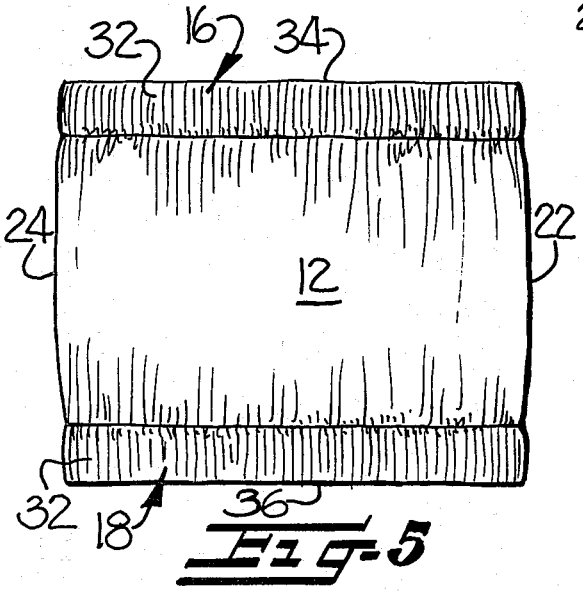
FIG. 5 is a view of the front of the sham of FIGS. 1–4, but showing the sham standing alone without an inserted pillow.
Figure 6:
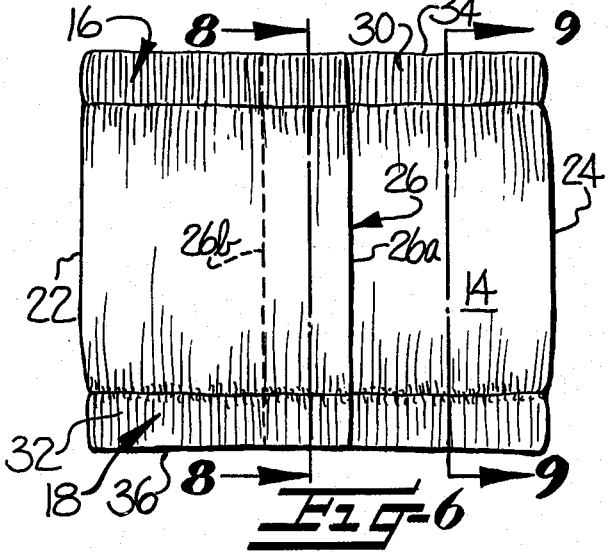
FIG. 6 is a view of the rear of the sham shown in FIG. 5, also shown without an inserted pillow.

Referring to FIG. 7B, rectangular sheet S with joined elastic strips 62, 64 is folded upon itself to form an open-ended tube. The tube is then closed by seams 34, 36 that are shown in the illustrations of the finished product in FIGS. 5 and 6. Seams 34, 36 incorporate elastic means in the form of elongate elastic strips 70, 72 (FIG. 7B) to form elasticized seams. The seams are formed with the elastic strips in a stretched condition so that when the strips relax, the sheet material adjacent the seams is gathered. Once seams 34, 36 are formed, the sham is turned inside out to complete the manufacturing operation.

Figure 8:
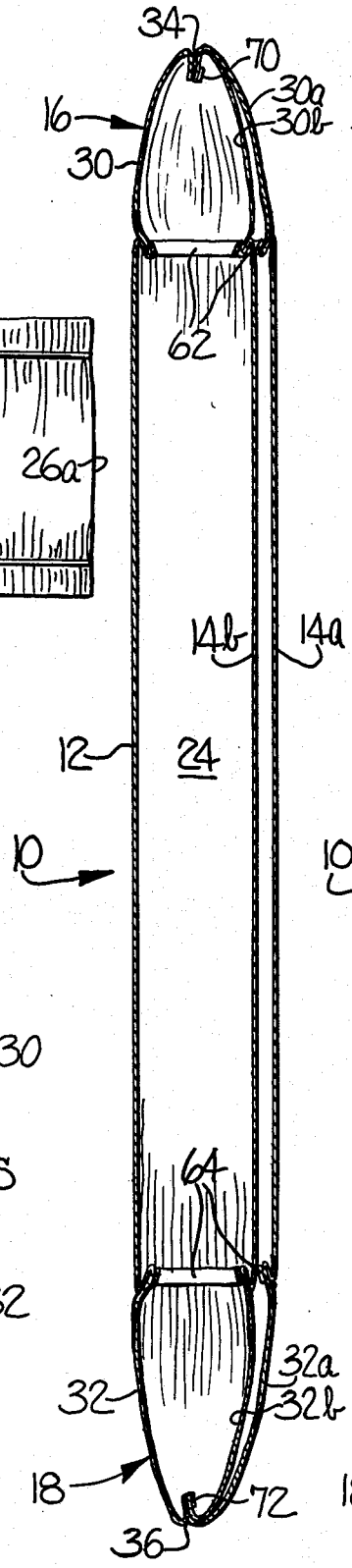
FIG. 8 is an enlarged sectional view taken substantially along line 8—8 of FIG. 6.
Figure 9:
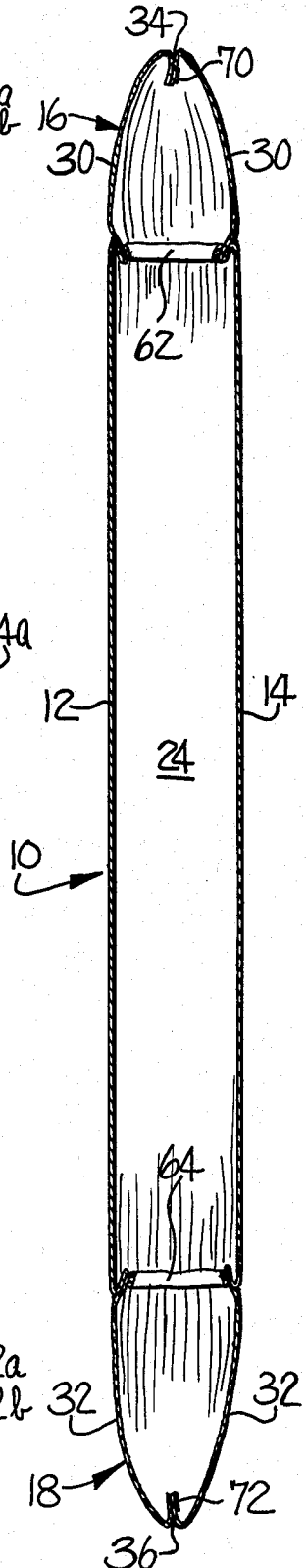
FIG. 9 is an enlarged sectional view taken substantially along line 9—9 of FIG. 6.

The sheet material adjacent the shorter edges **26*a* and 26*b* of sheet S overlap to form the previously mentioned pillow-receiving opening 26. The overlapping portions, identified in FIG. 8 by reference numerals 14***a*, 14*b*, 30*a*, 30*b*, 32*a*, 32*b*, extend completely across the rear of sham 10 from seam 34 to seam 36.

The gathering provided by elastic strips 62, 64, 70, 72 is preferably at a ratio on the order of 1.5 inches of fabric to 1 inch of relaxed elastic.

In order to make the illustrated sham in the mentioned size of approximately 21 by 26 inches and with a gathering ratio of 1.5 to 1, the rectangular sheet S may be formed 21 by 94 inches (with the length of the sheet thus being several times the width of the sheet), with the elastic strips 62, 64 each joined 3 inches from the lengthwise edges of sheet S and with an overlap at rear panel 14 on the order of 6 inches.

While the present invention has been described with reference to a preferred embodiment, it will be appreciated that modifications may be made without departing from the true spirit and scope of the invention.

That which is claimed is:

1. A pillow sham comprising an envelope of sheet material and including front and rear panels, opposed closed sides, opposite ends, and a pillow-receiving opening in the rear panel, said sham being formed from a single rectangular sheet of material with the length of the sheet of material being several times the width of the sheet, said sheet of material being folded upon itself in an overlapped fashion to present a pair of opposing faces, a pair of fold lines, an overlap and confronted side edges of the sheet, the opposing faces defining said front and rear panels, the fold lines defining said opposed ends and the overlap defining the pillow-receiving opening in the rear panel, seams joining together the confronted side edges of the sheet to define said opposed closed sides, elastic means incorporated into said seams for effecting a gathering of the sheet material adjacent thereto and presenting an overall gathered appearance to the sham, and a lengthwise-extending strip of elastic material secured to the sheet material on each side of each seam, the strips of elastic material being positioned and secured to the sheet material to effect a further enhanced gathered appearance for the sham.

2. A pillow sham as claimed in claim 1 wherein the gathering of sheet material adjacent said strips of elastic material and said seams is at a ratio on the order of 1.5 to 1.

* * * * *